United States Patent [19]

Watanabe et al.

[11] Patent Number: 4,684,017

[45] Date of Patent: Aug. 4, 1987

[54] COMPACT CASE

[75] Inventors: Nobuhisa Watanabe, Tokyo; Hisao Iwamoto; Toshihiro Nasuno, both of Odawara; Yoshio Sakamaki, Tokyo, all of Japan

[73] Assignees: Kanebo Limited; Yoshida Industry Co., Limited, both of Tokyo, Japan

[21] Appl. No.: 742,925

[22] Filed: Jun. 10, 1985

[30] Foreign Application Priority Data

Jun. 11, 1984 [JP] Japan ..... 59-85518[U]

[51] Int. Cl.[4] ..... B65D 85/68

[52] U.S. Cl. ..... 206/235; 206/581; 220/338; 220/341; 220/342; 220/343; 220/DIG. 26; 16/265; 16/267; 16/366

[58] Field of Search ..... 206/45.23, 45.24, 37, 206/38, 235, 581; 220/337, 338, 341, 342, 343, DIG. 26; 16/257, 262, 267, 265, 366

[56] References Cited

U.S. PATENT DOCUMENTS

| | | | |
|---|---|---|---|
| 2,308,625 | 1/1943 | Rathbun | 220/342 |
| 2,546,590 | 3/1951 | Ferrel | 220/342 |
| 2,601,101 | 6/1952 | Derham | 220/343 |
| 2,829,765 | 4/1958 | Burger | 206/37 R |
| 3,317,078 | 5/1967 | Gordon | 220/342 |
| 3,402,422 | 9/1968 | Baer | 16/366 |
| 3,680,927 | 8/1972 | Neureuther | 16/267 |
| 3,952,369 | 4/1976 | Erickson | 16/265 |
| 4,331,168 | 5/1982 | Hatakeyama | 206/235 |
| 4,372,331 | 2/1983 | Thompson | 206/235 |
| 4,454,889 | 6/1984 | Contreras, Sr. | 200/235 |
| 4,500,008 | 2/1985 | Cook | 220/342 |
| 4,553,665 | 11/1985 | Weick et al. | 206/37 |
| 4,569,438 | 2/1986 | Sheffler | 206/235 |
| 4,588,074 | 5/1986 | Strong et al. | 220/342 |

FOREIGN PATENT DOCUMENTS

| | | | |
|---|---|---|---|
| 29197 | 3/1956 | Fed. Rep. of Germany | 220/342 |
| 1279237 | 6/1972 | United Kingdom | 206/235 |

*Primary Examiner*—Joseph Man-Fu Moy
*Assistant Examiner*—David T. Fidei
*Attorney, Agent, or Firm*—Paul & Paul

[57] ABSTRACT

A compact case including a case proper and a lid member which are connected to each other through a hinge so that the case is freely opened and closed, wherein concave notches communicating with each other are formed in rear end portions of the case proper and lid member, the hinge is contained in the notches so that the rear end face of the hinge is not projected outward, the upper portion of the hinge is rotatably connected to the lid member through a first shaft, and the lower portion of the hinge is rotatably connected to the case proper through a second shaft.

3 Claims, 17 Drawing Figures

COMPACT CASE

BACKGROUND OF THE INVENTION (1) Field of the Invention

The present invention relates to a compact case comprising a case proper and a lid member, which are connected to each other through a shaft of a hinge so that the case can be optionally opened and closed.

(2) Description of the Related Art

In a conventional compact case of this type, a concave notch is formed at the rear end portion of one of a lid member and a case proper, a hinge piece is integrally projected on the rear end portion of the other of the lid member and the case proper, and the hinge piece is inserted into the concave notch and attached to a shaft laid out in the concave notch. In this hinge structure comprising the lid member and the case proper, when the lid member is closed, the rear end face of the lid member and the rear end face of the case proper are located in the same vertical plane and the hinge portion is not projected outward. This structure is preferred from an aesthetic viewpoint. However, when the lid member is opened by 180°, the end portions of the lid member and case proper are overlapped together in the hinge portion. Generally, the lid member is not opened by 180° while it is used. Accordingly, this overlapping does not cause any trouble during use.

A recent mode of selling compact cases is to pack the compact cases with a transparent film in the state with the lid member opened by 180° so that the cosmetic in the case proper can be seen from the outside. Such packaged compact cases are vertically hung for display. When this method is adopted, since, in case of a conventional compact case, one of the lid member and case proper overlaps the other in the hinge portion to produce a difference in level, trouble is readily caused at the step of automatic packaging and the packaging film is readily broken. Moreover, the aesthetic effect is impaired by the presence of this difference in level.

In another conventional compact case, a lid member is formed of a transparent plastic so the interior cosmetic can be seen from the outside even in the state where the lid member is closed and the case is packaged. In this case, a consumer can select an appropriate compact case while checking the color and the like of the interior cosmetic. However, this compact case is disadvantageous in that a mirror cannot be attached to the inner face of the lid member and thus, a user is not allowed to make up her face while viewing a mirror.

SUMMARY OF THE INVENTION

The present invention is to overcome the foregoing defects of conventional compact cases. Namely, it is a primary object of the present invention to provide a compact case in which a hinge is not projected outward as in a conventional compact case in the state where the lid member is closed and the lid member is not overlapped on the case proper but both the lid member and the case proper are arranged on the same plane in the state where the lid member is opened by 180° and which is suitable for packaging with a transparent or semi-transparent film.

More specifically, in accordance with the present invention, there is provided a compact case comprising a case proper and a lid member which are connected to each other through a hinge so that the case is freely opened and closed, wherein concave notches communicating with each other are formed in rear end portions of the case proper and lid member, the hinge is contained in the notches so that the rear end face of the hinge is not projected outward, and the upper portion of the hinge is rotatably connected to the lid member through a first shaft and the lower portion of the hinge is rotatably connected to the case proper through a second shaft.

DESCRIPTION OF THE PREFERRED EMBODIMENTS

Figure 1:
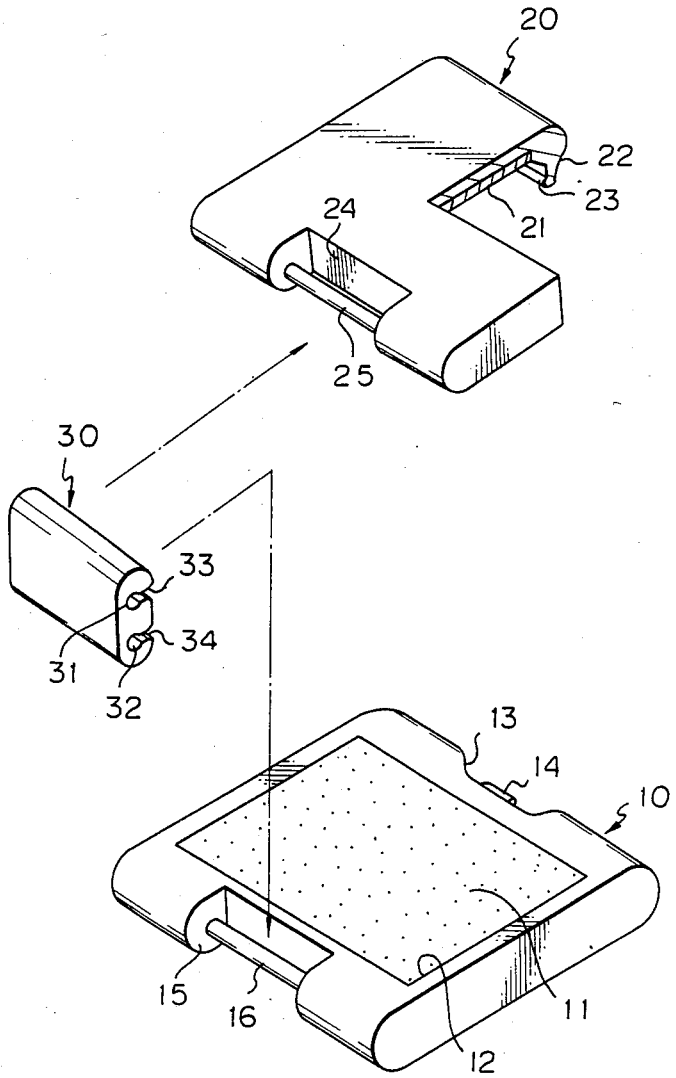
FIG. 1 is a partially exploded perspective view of a compact case according to a first embodiment of the present invention in the state where the case is separated into respective members.

FIGS. 1 through 7 illustrate a compact case according to a first embodiment of the present invention, which comprises a case proper 10, a lid member 20, and a hinge 30.

The case proper 10 is formed to have a substantially rectangular shape. A recess 12 for containing a cosmetic 11 therein is formed in the central portion of the case proper 10. An L-shaped cut 13 is formed at the center of the front end face of the case proper 10 and a first engaging projection 14 is formed on the interior face of the cut 13 integrally with the case proper 10. A first concave notch 15 piercing through the case proper 10 vertically is formed at the center of the rear end portion of the case proper 10, and a lateral pin 16 is laid out at the center of the notch 15 integrally with the case proper 10.

The lid member 20 is formed to have a substantially rectangular shape similar to that of the case proper 10, and a mirror 21 is integrally attached to the inner face of the lid member 20. A claw piece 22 is formed at the center of the front end of the lid member 20 so that it hangs down therefrom, and a second engaging projection 23 is integrally formed on the inner face of the claw piece 22. As in the case proper 10, a second concave notch 24 is formed in the central portion of the rear end of the lid member 20 so that the notch 24 pierces through the lid member 20 in the vertical direction. A second lateral pin 25 is integrally laid out at the center of the notch 24.

The hinge 30 is attached to the rear end portions of the case proper 10 and lid member 20 so that the case proper 10 and lid member 20 are freely openably and closably hinged together. The thickness in the front-rear direction of the hinge 30 is substantially equal to the front-rear width of the notches 15 and 24 of the case proper 10 and lid member 20, and the height of the hinge 30 is equal to the sum of the heights of the case proper 10 and lid member 20. Upper and lower separate through holes 31 and 32 are formed in the hinge 30. The diameters of the through holes 31 and 32 are substantially equal to the diameters of the first and second lateral pins 16 and 25. Lateral slits 33 and 34 having a diameter slightly smaller than that of the through holes 31 and 32 are formed to communicate with the through holes 31 and 32, respectively, and the lateral slits 33 and 34 are extended to the side portion of the hinge 30 and opened in this side portion. The hinge 30 is formed of plastic. Accordingly, the wall portion defining the lateral slits 33 and 34 has a certain elasticity.

Figure 2:
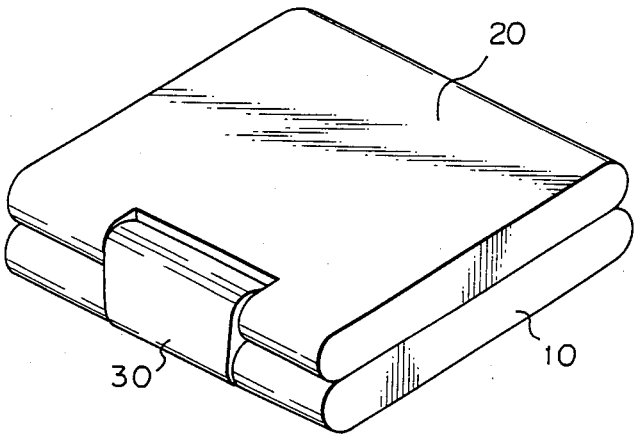
FIG. 2 is a perspective view of the state in which the lid member is closed.
Figure 3:
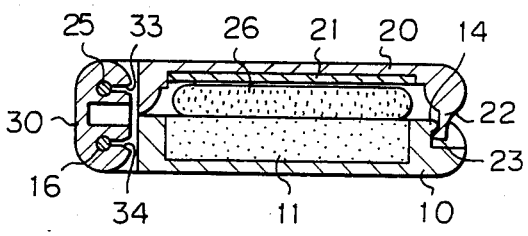
FIG. 3 is a sectional view of the state in which the lid member is closed.

For assembling the compact case of the first embodiment, the open end of the upper lateral slit 33 of the hinge 30 is fit with the second lateral pin 25 of the lid member 20, the hinge 30 is pushed to the lateral pin 25 to partially open the lateral slit 33, and the second lateral pin 25 is fit in the through hole 31. Similarly, the lateral pin 16 of the case proper 10 is fit with the open end of the lower lateral slit 34 of the hinge 30, and the lateral pin 16 is pushed to fit the lateral pin 16 in the lower through hole 32. Thus, the hinge 30 is built in the rear end portions of the case proper 10 and lid member 20, and when the lid member 20 is closed, the claw piece 22 on the front end portion of the lid member 20 is intruded in the L-shaped cut 13 on the front end face of the case proper 10. At this point, the second engaging projection 23 formed on the inner face of the claw piece 22 is engaged with the first engaging projection 14 formed on the interior face of the cut 13, and as shown in FIGS. 2 and 3, the lid member 20 is located at the closed position. At this closed position, a puff 26 is preferably contained within the lid member 20. At this closed position of the lid member 20, the hinge 30 is discretely contained within the concave notches 15 and 24 on the rear ends of the case proper 10 and lid member 20, and the hinge 30 forms a smooth surface contiguous to the top and rear faces of the lid member 20 and the bottom face of the case proper 10. Accordingly, no step projecting outward is formed by the hinge 30.

Figure 4:
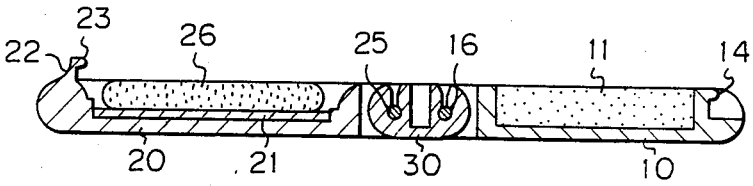
FIG. 4 is a sectional view of the state in which the lid member is opened by 180°.
Figure 5:
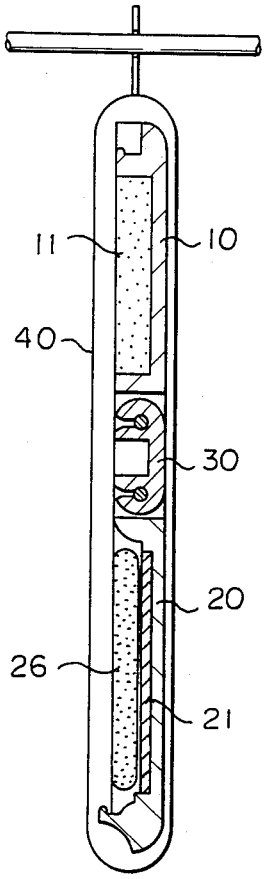
FIG. 5 is a sectional view of the compact case which is packaged in the state opened as shown in FIG. 4 and is displayed.
Figure 6:
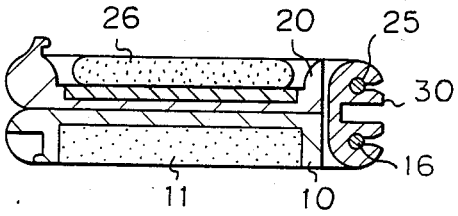
FIG. 6 is a sectional view of the state in which the case proper in the state shown in FIG. 4 is rotated by 360° in the opening direction.
Figure 7:
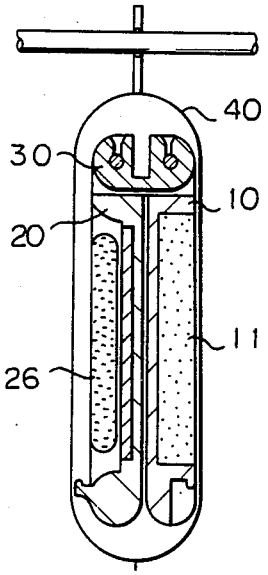
FIG. 7 is a sectional view of the compact case which is packaged in the state opened as shown in FIG. 6 and is displayed.

In the compact case according to the first embodiment of the present invention, at the position where the lid member 20 is opened by 180°, as shown in FIG. 4, the hinge 30 is kept horizontal and the lid member 20 is arranged linearly and horizontally with the case proper 10 without a level difference. Accordingly, if the compact case is packaged in this state, for example, with a transparent plastic film as shown in FIG. 5, the interior cosmetic 11 can be seen from the outside. Therefore, the compact case is suitably displayed for sale in the state in which the compact case is hung down from a hanging tool. Alternatively, in this compact case, the lid member 20 is opened by 360° so that the top face of the lid member 20 in FIG. 2 abuts with the bottom face of the case proper 10 as shown in FIG. 6. If the compact case is packaged in this state with a transparent plastic film 40 as shown in FIG. 7, the interior cosmetic 11 can be seen from the outside and the size of the case as packaged can be made smaller than in the state shown in FIG. 5. The compact case is suitably displayed for sale in this state, as in FIG. 5.

Figure 8:
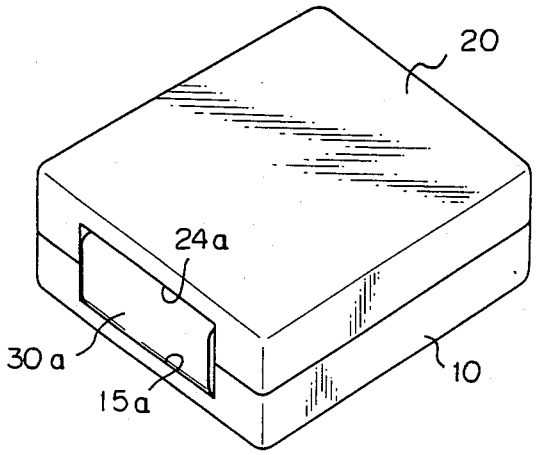
FIG. 8 is a perspective view of a compact case according to a second embodiment of the present invention in the state where the lid member is closed.
Figure 9:
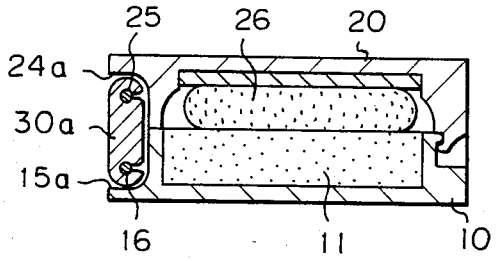
FIG. 9 is a sectional view of the state in which the lid member is closed.
Figure 10:
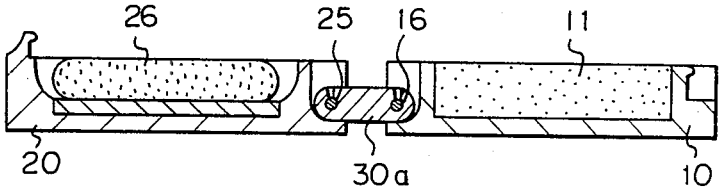
FIG. 10 is a sectional view of the state in which the lid member is opened by 180°.

FIGS. 8 through 10 illustrate a compact case according to a second embodiment of the present invention. In this embodiment, concave notches 15*a* and 24*a* formed on the rear end portions of the case proper 10 and lid member 20 do not pierce through the case proper 10 and lid member 20. A box-like concavity is defined by the concave notches 15*a* and 24*a*, and a hinge 30*a* is discretely contained in this concavity. As in the first embodiment, the hinge 30*a* is connected to the first lateral pin 16 of the case proper 10 and the second lateral pin 25 of the lid member 20. Also in this second embodiment, the hinge 30*a* is attached to the case proper 10 and lid member 20 so that in the state where the lid 20 is closed, the hinge 30*a* does not project outward beyond the rear end faces of the case proper 10 and lid member 20. When the compact case is packaged with a transparent film in the state where the lid member 20 is opened by 180° as sown in FIG. 10, the compact case is suitably displayed for sale as in the case shown in FIG. 5.

Figure 11:
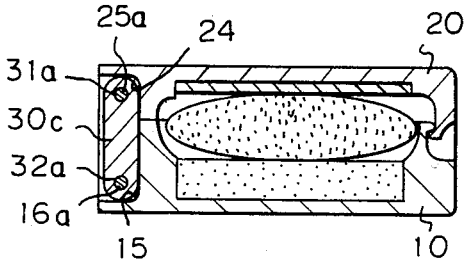
FIG. 11 is a sectional view of a compact case according to another embodiment of the present invention in the state in which the lid member is closed.

Incidentally, in the foregoing embodiments, lateral pins 16 and 25 are laid out in advance in the rear end portions of the case proper 10 and lid member 20, and the hinge 30 or 30*a* is fit by pressing the hinge 30 or 30*a* to these lateral pins 16 and 25 in the lateral direction. However, the connecting means used in the present invention are not limited to this method. For example, connection of the hinge can be accomplished according to a method shown in FIG. 11, in which small circular holes 31*a* and 32*a* free of a lateral slit are formed on both the upper and lower end portions of a hinge 30*c*, this hinge 30*c* is located in concave notches 15 and 24 formed on the rear ends of the case proper 10 and lid member 20, and pins 16*a* and 25*a* are inserted into these small circular holes of the hinge 30*c* from the rear ends.

Figure 12:
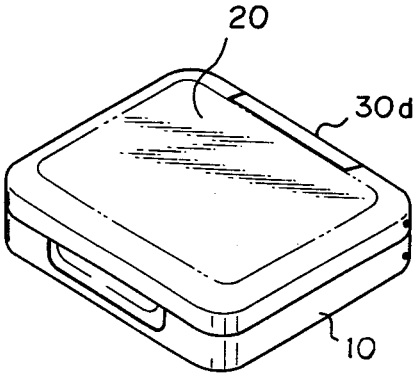
FIG. 12 is a perspective view of a compact case according to a preferred embodiment of the present invention in the state in which the lid member is closed.
Figure 13:
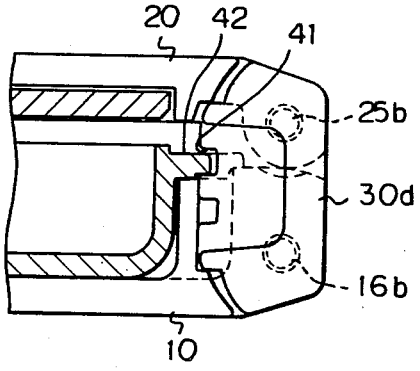
FIG. 13 is a sectional partial view of the state in which the lid member is closed.
Figure 14:
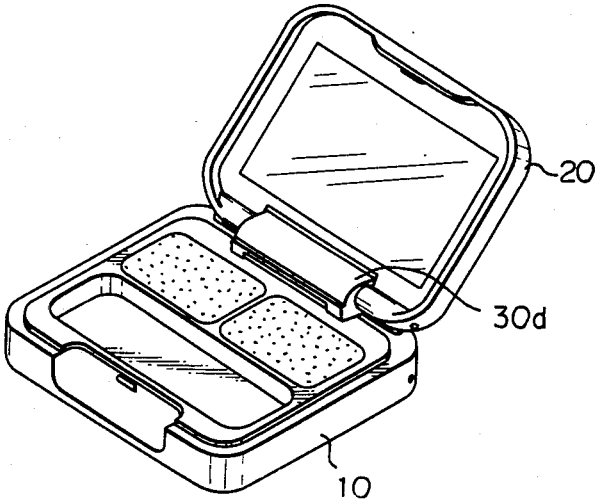
FIG. 14 is a perspective view of the state in which the lid member is opened to an intermediate anchoring position.
Figure 15:
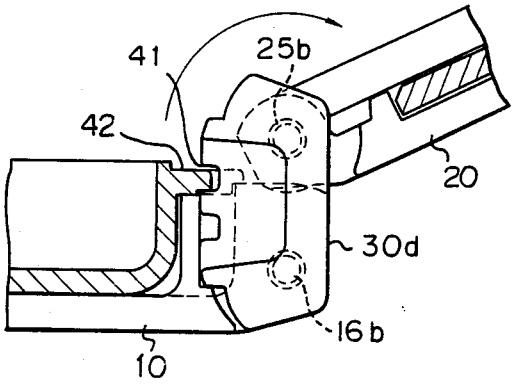
FIG. 15 is a sectional partial view of the compact case in the state shown in FIG. 14.

FIGS. 12 through 17 illustrate an especially preferred embodiment of the compact case according to the present invention. In this embodiment, a hinge 30*d* has a groove 41 with which an anchoring projection 42 of the case proper 10 is engaged. FIGS. 12 and 13 show the state in which the compact case is closed. As shown in FIGS. 14 and 15, if the lid member 20 of the compact case is opened and rotated around a pin 25*b* to an angle shown in the drawings, a part of the lid member 20 abuts against a part of the hinge 30*d* whereby further rotation of the lid member 20 around the pin 25*b* is prevented. If desired, the compact case is used in this state.

Figure 16:
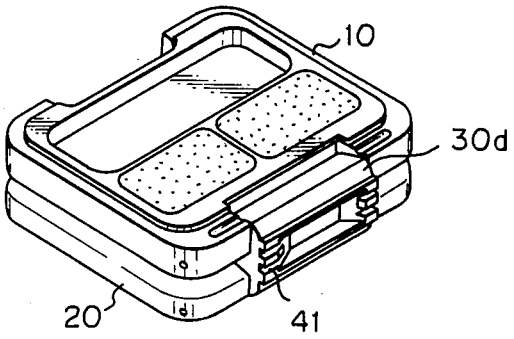
FIG. 16 is a perspective view of the state in which the lid member is opened by 360°.
Figure 17:
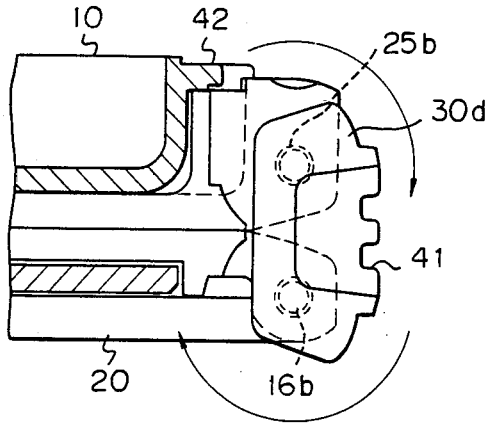
FIG. 17 is a sectional partial view of the compact case in the state shown in FIG. 16.

If further rotation of the lid member 20 is intended, the anchoring projection 42 of the case proper 10 is disengaged from the groove 41 of the hinge 30*d*, the lid member 20 is rotated around a pin 16*b* together with the hinge 30*d* in the state abutting agaihst the hinge 30*d*, and, finally, the lid member 20 is brought into the state rotated by 360° as shown in FIGS. 16 and 17.

An ordinary cosmetic, especially a solid cosmetic such as eye shadow, rouge, or foundation, may be contained in the compact case of the present invention. If desired, a small makeup tool such as a brush or puff, may also be contained in the compact case.

As is apparent from the foregoing description, in the compact case of the present invention, the hinge can be discretely attached so that the hinge is not projected outward in the state where the lid member is closed, and, when the lid member is opened by 180°, the rear end portion of the lid member does not overlap the case proper and the lid member and case proper are located on the same horizontal plane. Therefore, if the compact case is packaged in this state with a transparent film, the interior cosmetic can be seen from the outside, and the compact case can be suitably displayed for sale.

Especially in the case where concave notches piercing through the lid member and case proper in the vertical direction are formed on the rear end portions of the lid member and case proper and the hinge is attached to lateral pins of the lid member and case proper within these notches, the lid member can be opened by 360° and the compact case can be packaged with a transparent film with the size of the compact case as packaged reduced. Since the compact case is displayed in the thus-packaged state, the compact case of the present invention is very convenient for stores.

We claim:

1. A compact case comprising a case proper and a lid member which are connected to each other through a hinge so that the case is freely opened and closed, wherein concave notches communicating with each other are formed in rear end portions of the case proper and lid member, the hinge is contained in the notches so that the rear end face of the hinge is not projected outward rearwardly beyond the rear end portions of the case and the lid member when the case and lid member are closed, and the upper portion of the hinge is rotatably connected to the lid member through a first shaft and the lower portion of the hinge is rotatably connected to the case proper through a second shaft, wherein the hinge has a groove, the groove is engaged with an anchoring projection formed on the case proper, and said groove and projection cooperating to comprise means for temporarily anchoring the lid member on said anchoring projection when the lid member is rotated around the first shaft during opening of the lid member.

2. A compact case as set forth in claim 1, wherein the notches are formed so that the notches pierce through the lid member and case proper in the rear end portions thereof in the vertical direction.

3. A compact case as set forth in claim 1, wherein the hinge has a groove, the groove is engaged with an anchoring projection formed on the case proper, and when the lid member is rotated around the first shaft to open the lid member, the lid member is temporarily anchored during rotation by said anchoring projection.

* * * * *